US006955584B2

(12) United States Patent
Giurgiuman et al.

(10) Patent No.: US 6,955,584 B2
(45) Date of Patent: Oct. 18, 2005

(54) GRINDING MACHINE COMPRISING A MEASURING SYSTEM AND CONTROL FOR PROVIDING A MASTER BLADE AND METHOD FOR PROVIDING A BAR BLADE

(75) Inventors: Horia Traian Giurgiuman, Zürich (CH); Wilhelm Kreh, Radevormwald (DE); Joachim Thomas, Haar (DE)

(73) Assignee: Klingelnberg AG, Zurich (CH)

( * ) Notice: Subject to any disclaimer, the term of this patent is extended or adjusted under 35 U.S.C. 154(b) by 0 days.

(21) Appl. No.: 10/850,255

(22) Filed: May 20, 2004

(65) Prior Publication Data

US 2005/0064795 A1 Mar. 24, 2005

(30) Foreign Application Priority Data

Sep. 20, 2003 (DE) ..... 203 14 680 U

(51) Int. Cl.[7] ..... B24B 49/00

(52) U.S. Cl. ..... 451/5; 451/11; 451/45

(58) Field of Search ..... 451/5, 8, 9, 10, 451/11, 6, 45

(56) References Cited

U.S. PATENT DOCUMENTS

| | | | | |
|---|---|---|---|---|
| 5,193,314 | A * | 3/1993 | Wormley et al. | 451/5 |
| 5,387,061 | A * | 2/1995 | Barkman et al. | 409/80 |
| 5,645,466 | A * | 7/1997 | Wikle | 451/5 |
| 5,996,239 | A * | 12/1999 | Ohnheiser | 33/503 |
| 6,508,692 | B2 * | 1/2003 | Gottschalk | 451/5 |

* cited by examiner

*Primary Examiner*—Dung Van Nguyen
(74) *Attorney, Agent, or Firm*—McCormick, Paulding & Huber LLP

(57) ABSTRACT

An apparatus includes a blade grinding machine, a measuring system and a control for providing a bar blade suitable for cutting work pieces. The blade grinding machine includes a clamping mechanism for mounting the bar blade and a grinding wheel for grinding the mounted bar blade. The measuring system also includes a clamping mechanism for mounting bar blade and at least one probe for three-dimensional sampling of the bar blade mounted on the measuring system. The control enables a data exchange between the blade grinding machine and the measuring system in order to grind and sample the bar blade in an alternating fashion. The apparatus is a closed system in which data exchange is automated.

15 Claims, 2 Drawing Sheets

GRINDING MACHINE COMPRISING A MEASURING SYSTEM AND CONTROL FOR PROVIDING A MASTER BLADE AND METHOD FOR PROVIDING A BAR BLADE

CROSS-REFERENCE TO RELATED APPLICATION

The present patent application claims priority to German Patent Application DE 203 14 680.8, which was filed on 20 Sep. 2003 and is currently assigned to the applicant of the present application and is hereby incorporated in its entirety by reference.

FIELD OF THE INVENTION

The present invention concerns apparatus that comprise a grinding machine and a measuring system, the apparatus being designed to process bar blades. The apparatus is particularly well suited for correcting ground blades or for providing master blades. The present invention also concerns a method for providing bar blades.

BACKGROUND OF THE INVENTION

There are numerically controlled grinding machines for processing bar blades pursuant to a data set in order to give a blade the desired shape or in order to restore the shape of the blade. In order to be able to control the precision of the grinding of the bar blade, the bar blade can be removed from the grinding machine and it can be mounted in a special measuring system for sampling and testing it by means of probes.

This known method which is being used today in different ways has various disadvantages. The fact that such an apparatus comprises discrete components which are not being designed for interoperability, is one aggravating disadvantage of the known apparatus. If several processing and measuring steps are required, which is quite often so, multiple handovers from one system to the other are required.

It is an object of the invention to provide a method and an overall apparatus that reduces or completely avoids the known disadvantages.

It is an object of the present invention to provide a method and an overall system that suited for processing and providing master blades in particular.

SUMMARY OF THE INVENTION

The present invention resides in one aspect to an apparatus that includes a blade grinding machine, a measurement system and a control for providing a bar blade suitable for cutting work pieces. The blade grinding machine includes clamping means for mounting the bar blade and a grinding wheel for grinding the mounted bar blade. The measuring system also comprises clamping means for mounting the bar blade and at least one probe for three-dimensional sampling of the bar blade being mounted in the measuring system. The control enables data exchange between the blade grinding machine and the measuring system in order to grind and sample the bar blade in an alternating fashion. The above-described apparatus is a closed system in which data exchange is automated.

The present invention also resides in a method for providing a bar blade suitable for cutting work pieces using a closed loop apparatus with a blade grinding machine and a measuring machine. The bar blade is mounted in the blade grinding machine using a blade mounting support, the data set is also loaded in the machine and is preferably represented by machine independent neutral data that defines the bar blade. The data is converted into machine specific data and the bar blade is ground according to the machine specific data using a rotating grinding wheel mounted on the blade grinding machine. The bar blade is then removed from the blade grinding machine and mounted on a blade mounting support defined by the measuring system. The bar blade is then sampled using a probe to determine the actual three-dimensional shape of the bar blade expressed by means of an IS data set. A difference between the original data set and the IS data set is then determined and the data set corrected considering this difference in order to obtain a corrected data set. The above-described steps are repeated using the corrected data set until a bar blade is provided that corresponds to a given specification.

It is an advantage of an apparatus according to the invention that the measuring and correcting of bar blades takes place in a closed system. Due to this, numerous errors that occur in known systems can be avoided. According to the present invention it is possible to directly perform an adaptation of theoretically calculated data.

In an embodiment of the present invention, the above-described data exchange is carried out using neutral data and after the three-dimensional sampling corrected neutral data is determined this is provided as new blade grinding data for the further grinding of a bar blade. In addition, a robot can be employed for automatically loading the bar blade into the grinding machine and/or the measuring system. The grinding wheel of the apparatus can also be a profile grinding wheel preferably a dual grinding wheel. Moreover, the control can comprise a software module or the grinding machine can include a NC control which receives from the software module machine setting data correlated with the blade grinding data. The methods described therein can be carried out in an automated fashion preferably by using a robot and/or blade handling station it may also be carried it out without the interaction of an operator.

BRIEF DESCRIPTION OF THE DRAWINGS

Exemplary embodiments of the invention will be described in detail below in connection with drawings, which show.

DETAILED DESCRIPTION OF THE PREFERRED EMBODIMENTS

Figure 1:
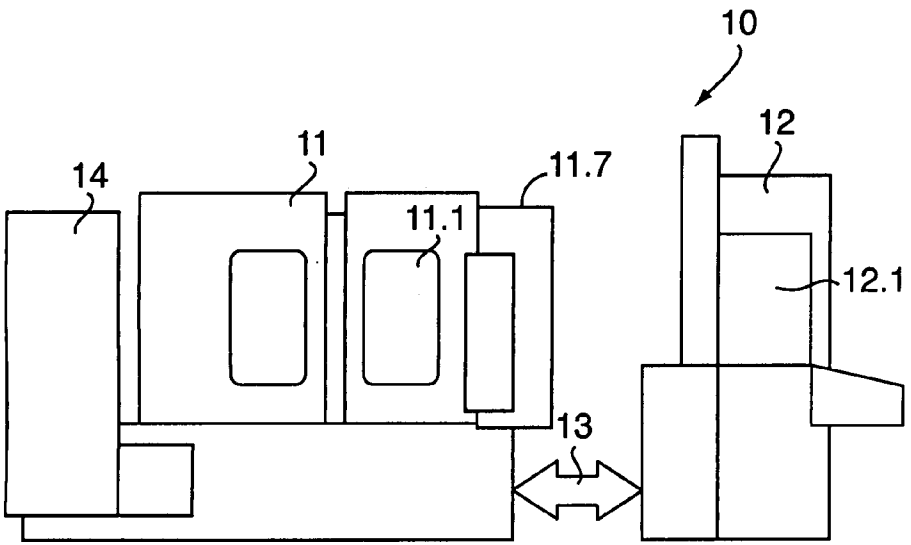
FIG. 1 a side view of a first apparatus, according to the present invention.

A first embodiment of the invention is described in connection with FIG. 1. The apparatus 10 comprises a blade grinding machine 11 and a measuring system 12. Both systems 11 and 12 are connected by means of a data line 13 or a bus for exchanging data sets. The blade grinding machine 11 comprises a door 11.1, for example, that can be opened in order for the bar blade to be processed to be loaded into the machine. The measuring system 12 in the shown embodiment comprises a door 12.1 for loading the bar blade, too.

Figure 2:
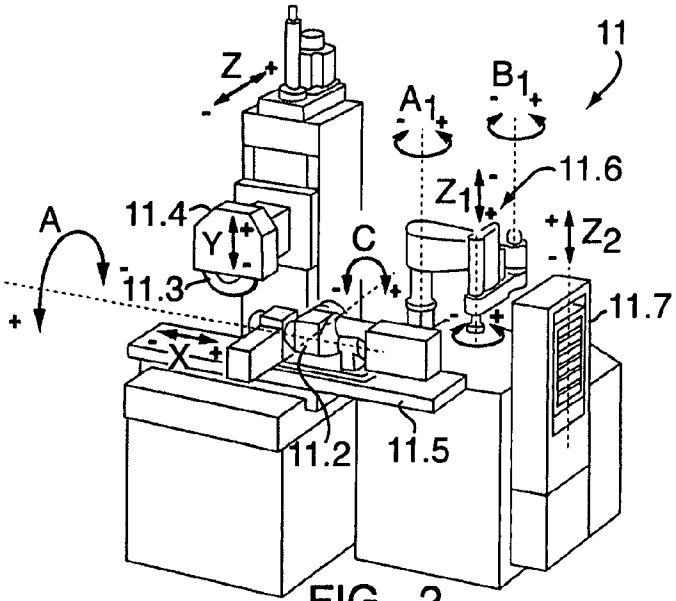
FIG. 2 the mechanical structure of a first blade grinding machine, according to the present invention.

The blade grinding machine 11 comprises, as illustrated in FIG. 2, clamping means 11.2 for mounting the bar blade and a grinding wheel 11.3 for profile grinding the mounted bar blade. Preferably, the clamping means 11.2 for mounting the bar blade is provided with hydraulic jaws in order to automate the mounting of the bar blade. The grinding wheel 11.3 sits on a grinding spindle 11.4 which can be moved by means of a Y-axis and a Z-axis drive. The bar blade rests on a slide 11.5 movable by a X-axis drive and rotatable by means of further drives around the A- and C-axis. For this purpose, the shaft of the bar blade is clamped onto the slide 11.5. Depending on the embodiment of the blade grinding machine 11, the bar blade can be manually or automatically (for instance by means of a robot, also called blade handling station) clamped onto the slide 11.5. A blade handling station 11.6 is shown in FIG. 2. The blade handling station 11.6 allows an automated feeding and handling of the bar blade. Preferably, the blade handling station 11.6 comprises a 4-axis control. A bar blade can, for instance, be handed over from the blade handling station 11.6 into a magazine 11.7. The bar blade can be moved from there into the measuring system 12.

Figure 3:
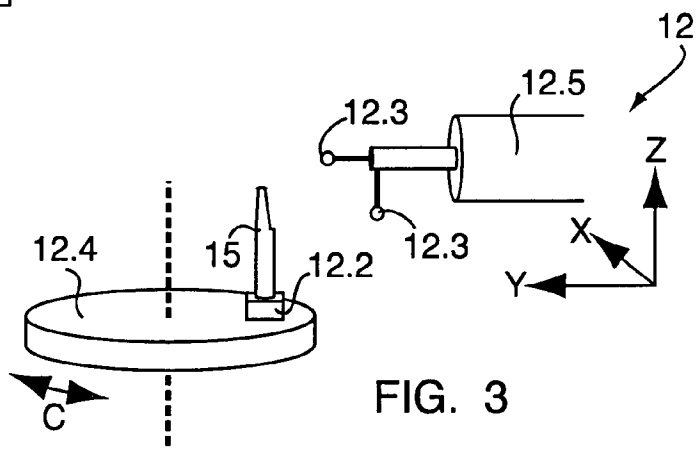
FIG. 3 the schematic structure of a first measuring system, according to the present invention.

The measuring system 12 further comprises clamping means 12.2 for mounting the bar blade, and at least one sensor 12.3 for 3-dimensional sampling of the bar blade (3D-sensing system) mounted in the measuring system 12, as illustrated in a simplified manner in FIG. 3. Preferably, the measuring system 12 is a fully-automated CNC controlled measuring center. In addition to the mechanical components of the measuring system 12, such as the bed, the drive for rotation of the bar blade around the C-axis, the horizontal, vertical and tangential measuring axis X, Y, and Z and the 3D-sensing system, a control with multiple controlled axis in connection with a computer ensure the functioning of the measuring system 12.

Furthermore, the apparatus 10 comprises a control 14 allowing a data exchange between the blade grinding machine 11 and the measuring system 12 in order to grind and sample the bar blade in an alternating fashion until it is useable as a master blade, for example. The control 14 may for example be situated in a cabinet on one side, as illustrated in FIG. 1. The apparatus 10 as a whole is realized as closed system in which the data exchange takes place in an automated fashion.

The control 14 may also be realized by means of a separate computer or server which is connected via a data link to the apparatus 10. The control 14 can also be realized as a decentralized system of computers where different computers or processors jointly handle control tasks and/or the conversion and adaptation of data.

Essentially, the blade grinding machine 11 comprises a blade mounting support 11.2 (also referred to as clamping means) for manually or automatically (for example by means of a robot) clamping the bar blade to be processed and a grinding wheel 11.3 for processing the bar blade. Preferably, the grinding wheel 11.3 is being rotated and actuated by a CNC control and different drives. It is advantageous to use a vitrified profile grinding wheel as grinding wheel 11.3 (for example a dual grinding wheel). When processing a bar blade, the blade grinding machine 11 loads a so-called data set which defines the bar blade in its three dimensions. Preferably, the bar blade is defined, respectively characterized, by means of machine independent neutral data. Using neutral data has the advantage that they can be used in the blade grinding machine 11 as well as in the measuring system 12, which is going to be described in the following section. Preferably, the blade grinding machine 11 comprises means (for example a software module) for converting the data set into machine specific machine data. These machine specific machine data are also called machine setting data, since they describe the nominal geometry of the bar blade depending on the constants of the machine.

The measuring system 12 essentially comprises a blade mounting support 12.2 (also referred to as clamping means) and two or three slides for sampling the bar blade 15 in a suitable coordinate system (for instance a X-Y-Z coordinate system). Preferably, one of the slides or a swivel support 12.4 carries the clamping means 12.2 and the bar blade to be sampled. Depending on the embodiment of the measuring system 12, a bar blade to be sampled can be manually or automatically (for instance using a robot) mounted on the slide or swivel support 12.4. Another slide 12.5 carries the probes 12.3. The slide or swivel support 12.4 with the bar blade 15 to be sampled puts it into a position and the probes 12.3 are being put into contact with the profile of the blade by moving the slide 12.5. Due to this, the 3-dimensional shape of the blade can be determined. Preferably, the measuring system 12 is equipped with a digital sampling system which is connected to the probes 12.3 by means of cables or the like.

If a bar blade 15 is to be sampled, the slide or swivel support 12.4 with the bar blade 15 is consecutively moved into a series of pre-calculated positions, referred to a given point of the bar blade (for instance the tip of the blade). At each pre-calculated position, the probe 12.3 is brought into contact with the profile of the blade. The position of the probe 12.3, respectively the slide 12.5 of the probe, is compared with a calculated (theoretical) value. This results in the so-called IS data (for instance IS-neutral data).

After the bar blade is ground in the grinding machine 11 according to given neutral data it is sampled in the measuring system 12 in all three dimensions, as described. The measuring system 12 displays the actual shape of the bar blade using the IS-neutral data, for instance, in order to make a distinction with respect to the theoretically calculated nominal neutral data. As a result of the measuring process the difference between the nominal neutral data and the IS-neutral data is determined. From this difference correcting data are obtained which are used to correct the nominal neutral data. The data obtained by the correction are referred to as corrected neutral data. After the corrected neutral data are provided to the blade grinding machine 11 via the data line 13, the bar blade profile is again ground in the blade grinding machine 11. Then, the bar blade is again sampled using the measuring system 12 in order to obtain new IS-neutral data. If necessary, these processing and sampling steps are repeated several times to finally provide a bar blade that corresponds to the specification.

The apparatus 10 with the blade grinding machine 11 and the measuring system 12, according to the invention, is particularly well suited to produce so-called master blades. A master blade is a blade that can be used in a cutting machine to cut the nominal geometry of a pre-defined gear with high precision. Using a master blade one is able to cut the "right" geometry of the flank of a gear. The master blade is not simply the result of precise mathematical calculations, but according to the present invention, other aspects are considered as well when processing it. The blade grinding machine 11 which is used for processing the master blade, for example, has a non-negligible influence on the final shape of the blade's geometry. Consequently, the master blade is not just an electronic data processing (data) object, but a physical object. All essential facets are, after having been processed by an apparatus according to the invention, geometrically and technically most precisely defined and its shape is verified by using the measuring system.

A method according to the present invention comprises the following steps. These steps are carried out in a closed-loop fashion in an apparatus 10 that combines a blade grinding machine 10 and a measuring system 12:

a) mounting the bar blade inside a blade grinding machine 11 using a blade mounting support 11.2;
b) loading a data set, preferably represented by machine independent neutral data, which defines the bar blade in its three dimensions;
c) converting the data set into machine specific data;
d) grinding the bar blade according to the machine specific data using a rotating grinding wheel of the blade grinding machine 11;
e) removing the bar blade from the blade grinding machine 11 and mounting it on a blade mounting support 12.2 of a measuring system 12;
f) sampling the blade with a probe 12.3 to determine the actual 3-dimensional shape of the bar blade, the actual shape being expressed by means of an IS data set;
g) exchanging data between the blade grinding machine 11 and the measuring system 12;
h) determining the difference between the data set and the IS data set,
i) correcting the data set considering the difference,
j) repeating steps a) through h) using the corrected data set until a bar blade is provided that corresponds to a specification.

Figure 4:
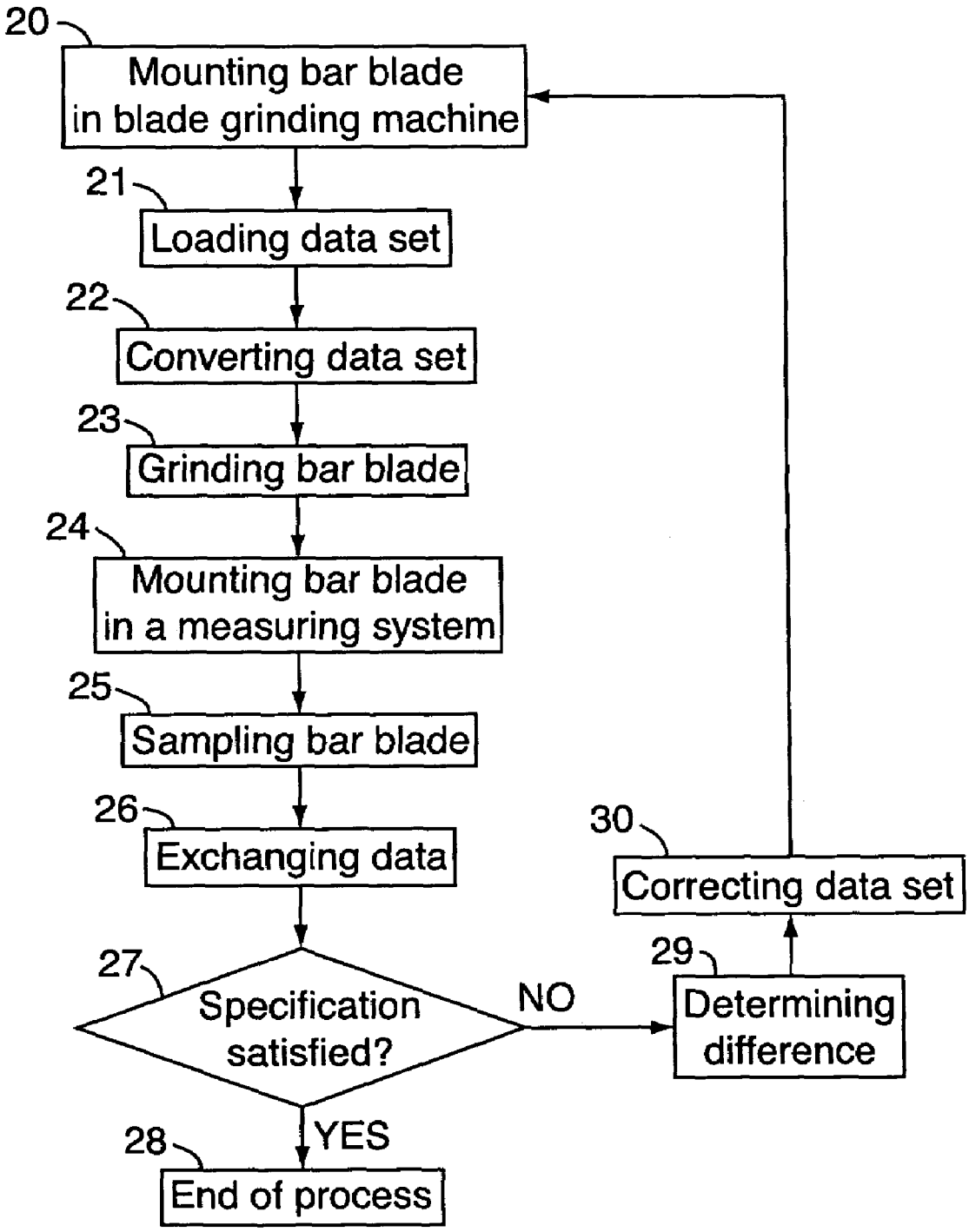
FIG. 4 the schematic flow chart of a first method, according to the present invention.

The above steps do not have to be carried out in the given order. A similar sequence of steps is illustrated in FIG. 4. After a bar blade is mounted inside a blade grinding machine 11 using a blade mounting support 11.2 (step 20), a data set is loaded which defines the bar blade in its three dimensions (step 21). The data set is loaded in order to make it available to a control 14 of the blade grinding machine 11. The data set is converted (step 22) into machine specific data that is machine readable, that is a data set that provides instructions for controlling the movements and activities of the blade grinding machine 11 while grinding the bar blade (step 23). Then, the bar blade is removed from the blade grinding machine and mounted in the measuring system 12 (step 24) where it is sampled in all three dimensions (step 25). Data are exchanged (step 26) in order to enable either the control 14 or a subsystem to judge whether a predefined specification is satisfied (step 27). This may be done by checking whether the result of the 3D-sampling provides an IS data set that is equal to or almost equal to the data set that was used to grind the blade in the first instance (cf. step 21). If the specification is satisfied, the flowchart branches and the process is finished (step 28). In this case, the bar blade can be removed or finishing steps can be carried out. Otherwise, the difference between the IS data set and the data set is determined (step 29), and a corrected data set is provided (step 30). The blade is again mounted in the blade grinding machine 11 (step 20) and the corrected data set is now used instead of the data set mentioned in step 21. The process is repeated always using the corrected data set until a bar blade is provided that corresponds to the given specification.

One may make a quasi electronic data processing master blade by means of an inventive apparatus. This electronic data processing master blade is defined by means of data and can simply be duplicated.

The apparatus as claimed is very well suited for profile grinding (generating grinding and/or form grinding) of carbide metal bar blades and highly alloyed high-speed steel blades.

Using an apparatus, according to the present invention, mainly the profile of the main relief flank, the clear relief flank and the rake flank of the bar blade are ground.

The apparatus as claimed allows bar blades to be made having a high quality regarding the geometry of the blade and its shape stability. Furthermore, the apparatus is more economical if compared with conventional apparatus. The costs of the tools can be optimized too, using the inventive apparatus.

What is claimed is:

1. Apparatus with a blade grinding machine, an automated measuring system and a control for providing a bar blade suitable for cutting work pieces, wherein the blade grinding machine comprises:

first clamping means for mounting the bar blade, a grinding wheel for grinding the mounted bar blade, wherein the automated measuring system comprises:

second clamping means for mounting the bar blade, at least one probe for three-dimensional sampling of the bar blade being mounted in the automated measuring system, and wherein the control enables a data exchange between the blade grinding machine and the automated measuring system in order to grind and sample the bar blade in an alternating fashion, the apparatus being a closed system in which the data exchange is automated.

2. An apparatus according to claim 1, wherein the grinding of the bar blade is done using blade grinding data which are given.

3. An apparatus according to claim 1, wherein the data exchange is carried out using neutral data and wherein after the three-dimensional sampling corrected neutral data are provided which serve as new blade grinding data for the further grinding of the bar blade.

4. An apparatus according to claim 1, wherein the control comprises a computer system and/or a communication network.

5. An apparatus according to claim 1, further comprising a robot for automatically loading the bar blade into the blade grinding machine and/or the measuring system.

6. An apparatus according to claim 1, wherein the grinding wheel is a profile grinding wheel.

7. An apparatus according to claim 1, wherein the control comprises a software module.

8. An apparatus according to claim 7, wherein the blade grinding machine comprises a NC-control which receives from the software module machine setting data being correlated with the blade grinding data.

9. An apparatus according to claim 1, wherein the grinding wheel is a dual grinding wheel.

10. A method for providing a bar blade suitable for cutting work pieces, using a closed-loop apparatus with a blade grinding machine and an automated measuring system, comprising the following steps:

a) mounting the bar blade in the blade grinding machine;
b) loading a first data set defining the bar blade;
c) converting the first data set into machine specific data;
d) grinding the bar blade according to the machine specific data using the blade grinding machine;
e) removing the bar blade from the blade grinding machine and mounting it on a blade mounting support of the automated measuring system;
f) automatically sampling the blade with a probe to determine the actual 3-dimensional shape of the bar blade, the actual shape being expressed by means of a second data set;

g) determining the difference between the first data set and the second data set, h) correcting the first data set considering the difference, in order to obtain a corrected data set;

i) repeating steps a) through g) using the corrected data set as the first data set until a bar blade is provided that corresponds to a given specification.

11. The method of claim 10, wherein the mounting of the bar blade is carried out in an automated fashion, preferably using a robot and/or a blade handling station.

12. The method of claim 10, wherein all steps are carried, out in a fully automated fashion without any interaction by an operator.

13. The method of claim 10, wherein the data set defines a master blade.

14. The method of claim 10, wherein the first data set is represented by machine independent neutral data.

15. A method for manufacturing a bar blade comprising the steps of:

a) grinding the bar blade according to a first data set;

b) automatically sampling the bar blade using an automated measuring system, said automated measuring system having at least one probe to determine the actual shape of the bar blade expressed as a second data set;

c) determining a corrected data set based at least in part on a difference between the first and second data sets;

d) replacing the first data set with the corrected data set; and e) repeating steps a) through d) until the bar blade corresponds to a specification.

* * * * *